United States Patent [19]

Gordon et al.

[11] 4,167,234

[45] Sep. 11, 1979

[54] SELF-STORING CONTAINER OPENING DISPENSING TAPE

[75] Inventors: Gerald A. Gordon, Skokie, Ill.; Karl Josephy, Los Angeles, Calif.

[73] Assignee: The Continental Group, Inc., New York, N.Y.

[21] Appl. No.: 930,096

[22] Filed: Aug. 1, 1978

[51] Int. Cl.[2] ..... B65D 41/00

[52] U.S. Cl. ..... 220/359; 220/270; 220/260

[58] Field of Search ..... 220/260, 265, 270, 359, 220/1 T; 229/7 R, 43, 65; 222/541

[56] References Cited

U.S. PATENT DOCUMENTS

| | | | |
|---|---|---|---|
| 3,201,030 | 8/1965 | Pollack | 229/65 |
| 3,687,328 | 8/1972 | Spruyt et al. | 220/1 T X |
| 4,029,033 | 6/1977 | Kerwin et al. | 222/541 X |

*Primary Examiner*—George T. Hall
*Attorney, Agent, or Firm*—Charles E. Brown

[57] ABSTRACT

A tape for sealing a dispensing opening in a container. The tape is permanently bonded at one end to the container adjacent a dispensing opening in the container, has an intermediate portion overlying the dispensing opening and sealed to the container wall around the dispensing opening, and a free end portion functioning as a grip. The tape differs from other similar tapes in that it is a laminate of two materials with one of the materials being a load bearing material and the other material being a rubbery material, whereby when the tape is removed from the dispensing opening in the usual manner, the load bearing material is stretched beyond its elastic limit and thus when the tape is released it will automatically coil up to an out-of-the-way position relative to the dispensing opening.

15 Claims, 4 Drawing Figures

SELF-STORING CONTAINER OPENING DISPENSING TAPE

This invention relates in general to new and useful improvements in easy opening containers, and more specifically to a sealing tape used in conjunction with such containers for temporarily sealing the dispensing openings therein.

It is customary to form a dispensing opening or openings in a container wall and to temporarily close the same by bonding a sealing tape to the container wall in overlying relation to the dispensing opening. Such tapes have first free ends which define grip portions, the grip portions being used to peel the tape off of the container wall so as to expose the dispensing opening. Such tapes have second ends permanently bonded to the container wall adjacent the dispensing opening. Thus the tape remains attached to the container wall at all times. The difficulty is that the tape has a tendency to flop back into overlying position relative to the dispensing opening and as such becomes a nuisance.

In accordance with this invention, it is proposed to utilize as a sealing tape a tape which is self-coiling so that once it is peeled off of the container wall to expose the dispensing opening and is released, it will automatically coil up and become seated on the container wall adjacent the dispensing opening in an out-of-the-way position.

A principal feature of the invention is that the tape prior to being applied to the container wall is a flat tape and can be handled in the same manner as other tapes. It is only when the tape is stretched during its removal from the container wall that the self-coiling characteristic thereof becomes activated.

Most specifically, in accordance with this invention there is provided a tape which is in the form of a laminate of a first material and a second material with the first material being a load bearing material intended to be sealed to the container wall and the second material being a rubbery material. When the tape is pulled to effect the peeling thereof from the container wall, the first material elongates beyond its elastic limit while the second material stretches fully within its elastic limit. Thus when the tape is released, the second material is urged back to its initial length while the first material remains elongated, thereby providing for different tensions on opposite sides of the center of the tape, and the resultant self-curling and self-storage of the tape.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
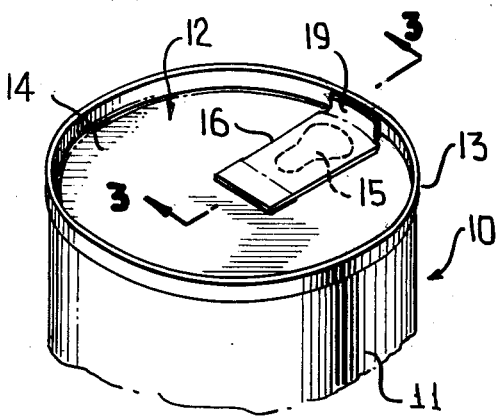
FIG. 1 is a top perspective view of the upper portion of an easy opening can incorporating the self-storing sealing tape of this disclosure.

Referring now to the drawings in detail, it will be seen that there is illustrated in FIG. 1 a conventional can or container of the easy opening type, the can being generally indentified by the numeral 10. The can 10 includes a body 11 having one end thereof closed by means of an end unit 12. The end unit 12 is secured to the body 11 by means of a conventional double seam 13 and includes a recessed end panel 14. The end panel 14 has formed therein a conventional dispensing opening 15.

The dispensing opening 15 is closed by a sealing tape 16. The sealing tape 16 has one end portion permanently bonded to the upper surface of the end panel 14 in spaced relation to the dispensing opening 15 by means of a first adhesive 17. An intermediate portion of the sealing tape 16 is peelably bonded to the end panel 14 surrounding the dispensing opening 15 by means of a second adhesive 18.

The sealing tape 16 has a second end portion 19 which may be readily gripped for the purpose of peeling the tape 16 partially from the end panel 14. The second end portion 19 may be of any configuration and if desired may have a finger grasping opening therethrough.

The container and the sealing tape as described above are all conventional. However, the sealing tape 16 is especially constructed and the characteristics of the sealing tape 16 form the subject of this invention.

Most specifically, the sealing tape 16 is a laminate. This is true of other sealing tapes. However, the physical characteristics of the two materials forming the laminate are quite different from those known in the prior art.

Most specifically, the sealing tape 16 is in the form of a laminate of a first material 20 and a second material 21. The first material is a load bearing material and is directly bonded to the end panel 14. The first material preferably has all of the necessary sealing characteristics required by the tape 16.

Most specifically, the first material has a low yield strength and a high ultimate tensile strength so that when it is tensioned to effect the removal thereof from the end panel 14, it is stretched beyond its elastic limit and permanently elongated. On the other hand, the ultimate tensile strength is sufficient to prevent accidental rupture of the material during the normal removal of the tape.

The second material is a rubbery material. This rubbery material 21 is readily elongated, but does not have its yield strength exceeded during the normal removal of the tape 16 so that it has a tendency to return to its original length.

From the foregoing understanding of the constructions of the laminate materials 20, 21, it will be readily apparent that in its initial state the tape 16 will lie flat and may be utilized in the same manner as existing sealing tapes. As of the time of application of the tape 16, the yield strength of neither of the materials has been exceeded. Thus, the first material has the same length as the second material.

Figure 2:
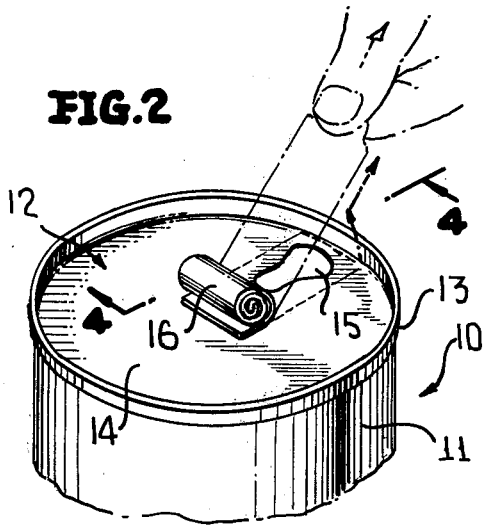
FIG. 2 is a fragmentary perspective view similar to FIG. 1, and shows the sequence of removing the tape from an overlying position relative to the dispensing opening and the release thereof with the ultimate coiling of the tape.
Figure 3:
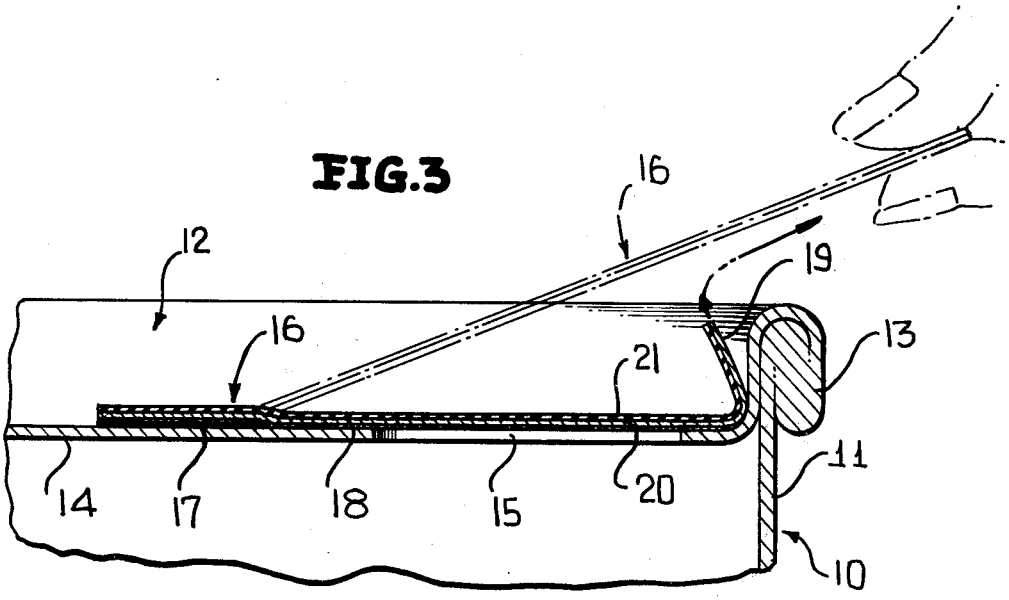
FIG. 3 is an enlarged fragmentary vertical sectional view taken along the line 3—3 of FIG. 1, and shows the tape both in its applied state and in its stretched state peeled from the can except for that portion thereof which is permanently anchored to the can.
Figure 4:
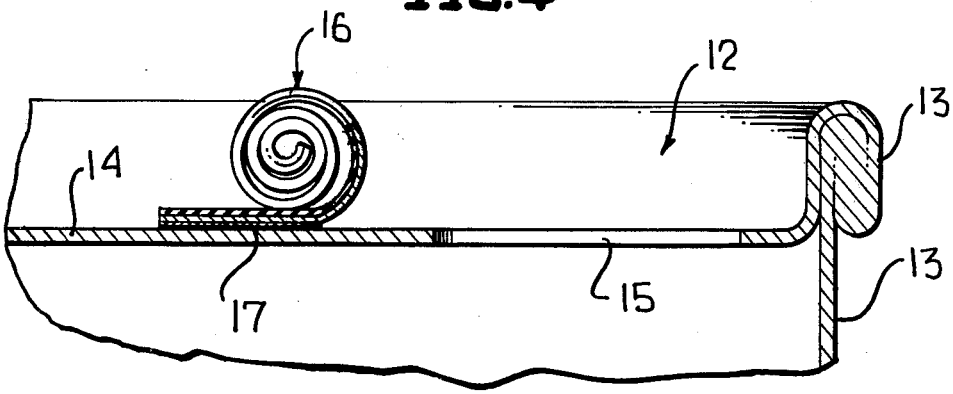
FIG. 4 is an enlarged fragmentary vertical sectional view taken along the line 4—4 of FIG. 2, and shows the tape removed from the dispensing opening closing position and coiled into a self-storing position.

When the tape 16 is tensioned in the removal of the tape from its position overlying the dispensing opening 15, both materials 20 and 21 are stretched or elongated with the material 20 being elongated beyond its yield limit and thus is permanently deformed so as to have a length materially greater than its original, as applied, length. On the other hand, the rubbery material 21 tries to return to its original length, its yield strength not having been exceeded. It will be apparent that the only way that the material 21 can return to approximately its original length is to effect a curling of the material so that it is disposed innermost. Thus, the once stretched tape 16 will automatically coil up when released to the position shown in FIGS. 2 and 4.

Since the tape 16 is permanently bonded to the end panel 14 in spaced relation to the dispensing opening 15, it will be seen that the tape automatically effects the self-storing thereof in a position where it in no way interferes with the dispensing of the product from the container through the dispensing opening 15.

Limited experimentation has been carried out and it has been found that a combination of MYLAR as the first material and an acrylic acid copolymer has the necessary rubbery material characteristic to be the second material. Tapes formed from a laminate of about 1 mil of acrylic acid copolymer and ½ mil of MYLAR have proved to be quite operable. The MYLAR possesses the necessary sealing characteristics and at the same time is readily bondable to metal and plastic materials which may be utilized in the formation of the can.

It will be readily apparent that other combinations will become available. For example, the MYLAR may be replaced by polypropylene, particularly when the polypropylene is in its cast or unoriented state.

Although only a preferred embodiment of the invention has been specifically illustrated and described herein, it is to be understood that minor variations may be made in the tape, particularly the materials of construction thereof, without departing from the spirit and scope of the invention as defined by the appended claims.

We claim:

1. A new article of manufacture comprising a self-coiling tape for sealing a dispensing opening, said tape being a laminate of first and second materials and having a normal planar static state, said first material being a load bearing material, and said second material being a rubbery material, said tape having inner and outer surfaces when in the position of intended use, and said first material being innermost.

2. The tape of claim 1 wherein said load bearing material has a low yield strength and a high ultimate tensile strength.

3. The tape of claim 1 wherein said first material is a plastics material having physical characteristics suitable for bonding to metal.

4. The tape of claim 3 wherein said plastics material is MYLAR.

5. The tape of claim 3 wherein said plastics material is unoriented polypropylene.

6. The tape of claim 1 wherein said second material is an acrylic acid copolymer.

7. The tape of claim 1 wherein said tape is secured to a container wall, said container wall has a dispensing opening therein, said tape overlies said dispensing opening and is sealed to said container wall surrounding said dispensing opening for temporarily closing said dispensing opening.

8. The tape of claim 7 wherein said tape includes first and second end portions, said first end portion being free of said container wall and defining a grip portion, and said second end portion being permanently secured to said container wall adjacent said dispensing opening.

9. The tape of claim 7 wherein the seal between said tape and said container wall is of a strength to effect permanent elongation of said first material during the normal removal of said tape from its position overlying said dispensing opening.

10. The tape of claim 1 wherein both of said materials are plastics materials.

11. A closure comprising a tape of the type peelably adhered to a wall of a container in an area circumjacent a pour opening in said container wall in covering relation to said pour opening and non-removably secured at one end to said wall outside said area, said tape being of a construction requiring said tape being pulled and at least in part permanently stretched attendant to being peeled off said container wall and including means operative upon release of said stretched tape for rolling said tape up toward its secured end.

12. A closure in accordance with claim 11 wherein said tape is a laminate of at least two different materials having different elongation characteristics.

13. A closure in accordance with claim 12 wherein said different materials include a first material in the form of a load bearing material and a second material in the form of a rubbery material.

14. A closure in accordance with claim 11 wherein said tape is formed of plastics material.

15. A closure comprising a tape of the type peelably adhered to a wall of a container in an area circumjacent a pour opening in said container wall in covering relation to said pour opening and non-removably secured at one end to said wall outside said area, the securement of said tape to said wall being of a nature requiring said tape being pulled attendant to being peeled off said container wall and including means operative upon release of said tape for rolling said tape up toward its secured end.

* * * * *